US009575428B2

(12) United States Patent
Sato et al.

(10) Patent No.: US 9,575,428 B2
(45) Date of Patent: Feb. 21, 2017

(54) ELECTROSTATIC-IMAGE DEVELOPING TONER, ELECTROSTATIC IMAGE DEVELOPER, AND TONER CARTRIDGE

(71) Applicant: FUJI XEROX CO., LTD., Tokyo (JP)

(72) Inventors: Narumasa Sato, Kanagawa (JP); Kotaro Yoshihara, Kanagawa (JP); Daisuke Ishizuka, Kanagawa (JP); Asafumi Fujita, Kanagawa (JP); Erina Saito, Kanagawa (JP); Yuka Kawamoto, Kanagawa (JP); Noriyuki Mizutani, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/926,826

(22) Filed: Oct. 29, 2015

(65) Prior Publication Data

US 2016/0342101 A1 Nov. 24, 2016

(30) Foreign Application Priority Data

May 22, 2015 (JP) ..... 2015-104738

(51) Int. Cl.
*G03G 9/087* (2006.01)
*G03G 9/08* (2006.01)
*G03G 9/107* (2006.01)

(52) U.S. Cl.
CPC ..... *G03G 9/08755* (2013.01); *G03G 9/0827* (2013.01); *G03G 9/107* (2013.01)

(58) Field of Classification Search
CPC ..... G03G 9/0827; G03G 9/08755; G03G 9/08795; G03G 9/08797; G03G 9/09307; G03G 9/107
See application file for complete search history.

(56) References Cited

U.S. PATENT DOCUMENTS

| | | | | |
|---|---|---|---|---|
| 9,152,066 | B2 | 10/2015 | Inoue et al. | |
| 2009/0103950 | A1* | 4/2009 | Nakayama | G03G 9/08711 399/252 |
| 2015/0079513 | A1* | 3/2015 | Fukuoka | G03G 9/113 430/108.4 |

FOREIGN PATENT DOCUMENTS

| | | | |
|---|---|---|---|
| JP | 2004-54095 | A | 2/2004 |
| JP | 2006-178093 | A | 7/2006 |
| JP | 2013-218293 | A | 10/2013 |

* cited by examiner

*Primary Examiner* — Sandra Brase
(74) *Attorney, Agent, or Firm* — Sughrue Mion, PLLC

(57) ABSTRACT

An electrostatic-image developing toner contains toner particles. The toner particles contain a binder resin, a release agent, and a styrene-(meth)acrylic resin. The binder resin contains a polyester resin. About 70% or more of all release agent is present within about 800 nm from surfaces of the toner particles. The styrene-(meth)acrylic resin is present in an amount of about 5 to about 25 atomic percent of the resin components in the surfaces of the toner particles as determined by X-ray photoelectron spectroscopy (XPS).

20 Claims, 2 Drawing Sheets

ELECTROSTATIC-IMAGE DEVELOPING TONER, ELECTROSTATIC IMAGE DEVELOPER, AND TONER CARTRIDGE

CROSS-REFERENCE TO RELATED APPLICATIONS

This application is based on and claims priority under 35 USC 119 from Japanese Patent Application No. 2015-104738 filed May 22, 2015.

BACKGROUND (i) Technical Field

The present invention relates to electrostatic-image developing toners, electrostatic image developers, and toner cartridges.

(ii) Related Art

Techniques such as electrophotography for visualization of image information via electrostatic images are currently used in various fields. In electrophotography, an electrostatic image corresponding to image information is formed on a surface of an image carrier (photoreceptor) in charging and exposure steps. The electrostatic image is developed with a developer containing a toner to form a toner image on the surface of the photoreceptor. The toner image is transferred to a recording medium such as paper in a transfer step and is fixed to the surface of the recording medium in a fixing step to form a visible image.

SUMMARY

According to an aspect of the invention, there is provided an electrostatic-image developing toner containing toner particles. The toner particles contain a binder resin, a release agent, and a styrene-(meth)acrylic resin. The binder resin contains a polyester resin. About 70% or more of all release agent is present within about 800 nm from surfaces of the toner particles. The styrene-(meth)acrylic resin is present in an amount of about 5 to about 25 atomic percent of the resin components in the surfaces of the toner particles as determined by X-ray photoelectron spectroscopy (XPS).

BRIEF DESCRIPTION OF THE DRAWINGS

Exemplary embodiments of the present invention will be described in detail based on the following figures, wherein.

DETAILED DESCRIPTION

Figure 1:
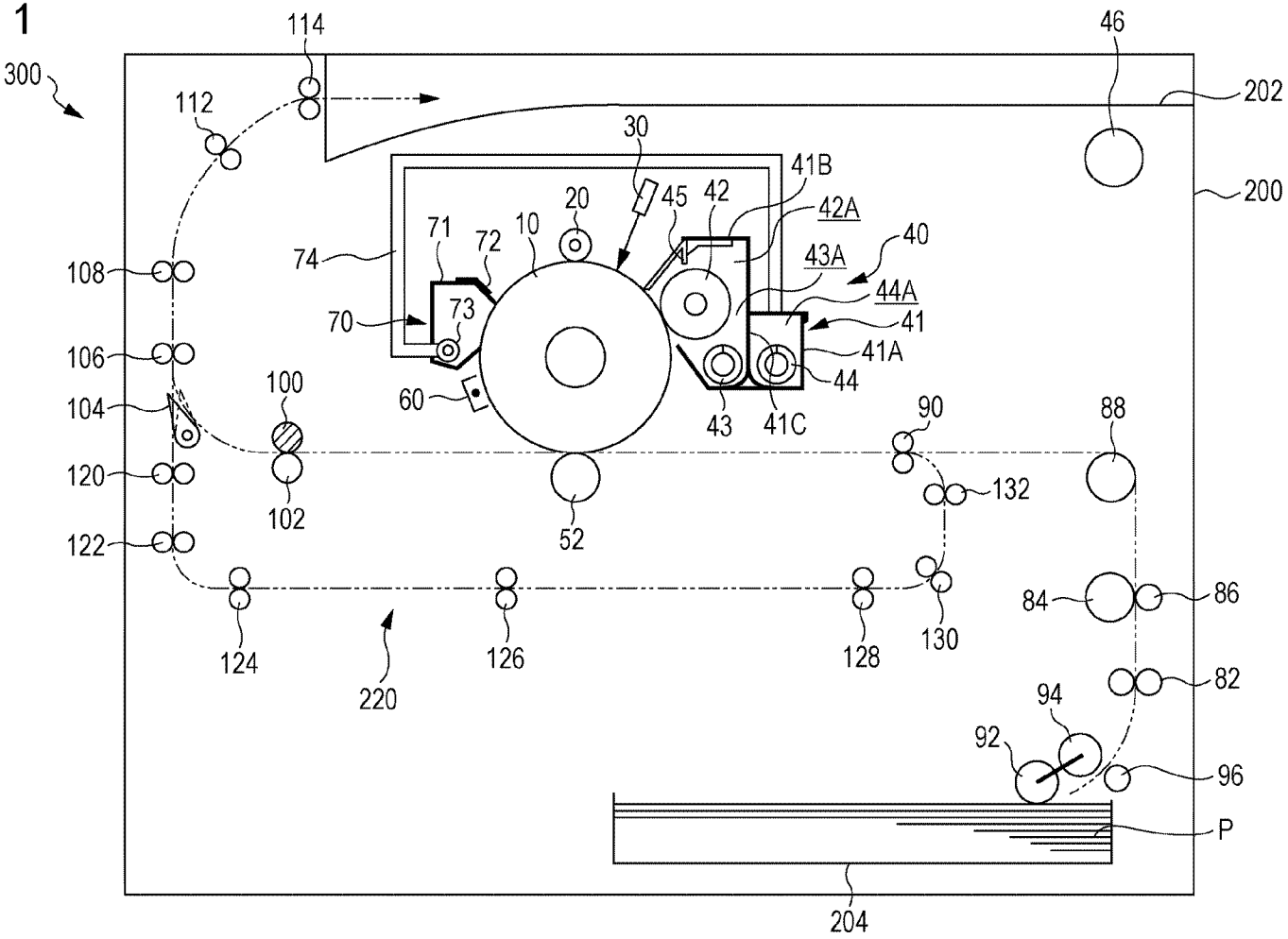
FIG. 1 is a schematic view of an example of an image-forming apparatus according to an exemplary embodiment of the present invention.

Exemplary embodiments of the present invention will now be described.

Electrostatic-Image Developing Toner

An electrostatic-image developing toner (hereinafter referred to as "toner") according to an exemplary embodiment of the present invention contains toner particles. The toner particles contain a binder resin, a release agent, and a styrene-(meth)acrylic resin. The binder resin contains a polyester resin.

70% or more or about 70% or more of all release agent is present within 800 nm or about 800 nm from the surfaces of the toner particles (the proportion of the release agent present within 800 nm or about 800 nm from the surfaces of the toner particles is hereinafter also referred to as "the presence rate of the release agent").

The styrene-(meth)acrylic resin is present in an amount of 5 to 25 atomic percent or about 5 to about 25 atomic percent of the resin components in the surfaces of the toner particles as determined by XPS (the proportion of the styrene-(meth) acrylic resin in the resin components present in the surfaces of the toner particles as determined by XPS is hereinafter also referred to as "the surface presence rate of the styrene-(meth)acrylic resin").

The above properties of the toner according to this exemplary embodiment may reduce color spots and streaks. Although the mechanism is not fully understood, a possible explanation is as follows.

For reasons of economy and resource conservation, some image-forming apparatuses are configured such that residual toner is removed from a surface of an image carrier (photoreceptor) by a cleaning unit and is supplied to and reused as toner by a developing unit (i.e., toner reclaim systems).

For example, in image-forming apparatuses with high process speeds (i.e., high-speed systems), toners in which a release agent is localized in the surface layer of the toner particles (e.g., within 800 nm or about 800 nm from the surfaces of the toner particles) are used to smoothly separate a fixed image from a fixing member.

However, if a toner in which a release agent is localized in the surface layer of the toner particles is used in a toner reclaim image-forming apparatus, the resulting images may have color spots and/or color streaks. It has been found that this phenomenon tends to occur noticeably when images with low area coverages (e.g., 1%) are formed at high temperature and humidity (e.g., 35° C. and 90% RH).

This phenomenon can be explained as follows. In toner reclaim image-forming apparatuses, mechanical loads (stresses) are repeatedly applied to residual toner on a surface of an image carrier, particularly in a cleaning unit. When such mechanical loads are repeatedly applied to a toner in which a release agent is localized in the surface layer of the toner particles, the release agent present in the surface layer of the toner particles tends to be excessively exposed in the surfaces of the toner particles. The release agent exposed in the surfaces of the toner particles tends to adhere to, for example, a member forming a supply transport path through which removed toner is supplied to a developing unit. The release agent adhering to the member forming the supply transport path tends to form toner aggregates. As the toner aggregates are supplied through the supply transport path to the developing unit, they are transferred from the developing unit to the surface of the image carrier. The transferred toner aggregates tend to leave color spots or streaks in images.

For the toner according to this exemplary embodiment, the presence rate of the release agent is 70% or more or about 70% or more, and the surface presence rate of the styrene-(meth)acrylic resin is 5 to 25 atomic percent or about 5 to about 25 atomic percent.

The styrene-(meth)acrylic resin present in the surfaces of the toner particles is similar in chemical structure to the release agent (e.g., a hydrocarbon wax) and is therefore believed to have a higher affinity for the release agent than, for example, the polyester resin used as the binder resin in the toner particles. If the toner according to this exemplary embodiment is used, the release agent may tend to adhere to the styrene-(meth)acrylic resin present in the surfaces of the toner particles. As a result, even if the release agent adheres to the member forming the supply transport path, the release agent may adhere to the styrene-(meth)acrylic resin, which is present in a particular proportion in the surfaces of the toner particles, and may be removed from the member forming the supply transport path. This may inhibit the formation of toner aggregates from release agent adhering to the member forming the supply transport path and may thus reduce color spots and streaks.

If the surface presence rate of the styrene-(meth)acrylic resin is excessively high, excess release agent adheres to the styrene-(meth)acrylic resin and may form toner aggregates. Thus, fewer color spots and streaks may occur if the surface presence rate of the styrene-(meth)acrylic resin falls within the above particular range.

As discussed above, the toner according to this exemplary embodiment may cause fewer color spots and streaks.

Although the use of the toner according to this exemplary embodiment in toner reclaim image-forming apparatuses has been described above, it may also be used in other types of image-forming apparatuses.

The toner according to this exemplary embodiment will now be described in greater detail.

The toner according to this exemplary embodiment contains toner particles and optionally an external additive.

Toner Particles

The toner particles contain, for example, a binder resin, a release agent, a styrene-(meth)acrylic resin, and optionally a colorant and other additives. The binder resin may contain a polyester resin.

Binder Resin

The binder resin may be a polyester resin.

Examples of polyester resins include known polyester resins. The polyester resin may be used in combination with a crystalline polyester resin. The crystalline polyester resin may be present in an amount of 2% to 40% (preferably 2% to 20%) of the total mass of the binder resin.

The term "crystalline" means that the resin shows a distinct endothermic peak, rather than a stepwise change in the amount of heat absorbed, in differential scanning calorimetry (DSC). Specifically, it means that the half-width of the endothermic peak measured at a heating rate of 10° C./min is within 10° C.

Polyester Resin

Examples of polyester resins include polycondensates of polycarboxylic acids with polyhydric alcohols. The polyester resin may be either obtained commercially or synthesized.

Examples of polycarboxylic acids include aliphatic dicarboxylic acids (e.g., oxalic acid, malonic acid, maleic acid, fumaric acid, citraconic acid, itaconic acid, glutaconic acid, succinic acid, alkenylsuccinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), and anhydrides and lower (e.g., $C_1$-$C_5$) alkyl esters thereof. For example, aromatic dicarboxylic acids may be used.

These dicarboxylic acids may be used in combination with bridged or branched carboxylic acids having a functionality of three or more. Examples of carboxylic acids having a functionality of three or more include trimellitic acid, pyromellitic acid, and anhydrides and lower (e.g., $C_1$-$C_5$) alkyl esters thereof.

These polycarboxylic acids may be used alone or in combination.

Examples of polyhydric alcohols include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., bisphenol A-ethylene oxide adduct and bisphenol A-propylene oxide adduct). Preferable polyhydric alcohols include aromatic diols and alicyclic diols, more preferably aromatic diols.

These diols may be used in combination with bridged or branched polyhydric alcohols having a functionality of three or more. Examples of polyhydric alcohols having a functionality of three or more include glycerol, trimethylolpropane, and pentaerythritol.

These polyhydric alcohols may be used alone or in combination.

The polyester resin preferably has a glass transition temperature (Tg) of 50° C. to 80° C. or about 50° C. to about 80° C., more preferably 50° C. to 65° C. or about 50° C. to about 65° C.

The glass transition temperature may be determined from a DSC curve obtained by DSC. More specifically, the glass transition temperature (Tg) may be determined as the extrapolated glass transition onset temperature defined in the "Determination of Glass Transition Temperature" section of JIS K 7121-1987 "Testing Methods for Transition Temperatures of Plastics".

The polyester resin preferably has a weight average molecular weight (Mw) of 5,000 to 1,000,000 or about 5,000 to about 1,000,000, more preferably 7,000 to 500,000 or about 7,000 to about 500,000.

The polyester resin may have a number average molecular weight (Mn) of 2,000 to 100,000 or about 2,000 to about 100,000.

The polyester resin preferably has a molecular weight distribution Mw/Mn of 1.5 to 100 or about 1.5 to about 100, more preferably 2 to 60 or about 2 to about 60.

The weight average molecular weight and the number average molecular weight may be determined by gel permeation chromatography (GPC). GPC measurements are performed on a Tosoh HLC-8120 GPC system equipped with a Tosoh TSKgel Super HM-M column (15 cm) using tetrahydrofuran (THF) as an eluent and are calibrated with a molecular weight calibration curve obtained from monodisperse polystyrene standards to determine the weight average molecular weight and the number average molecular weight.

The polyester resin may be prepared by known processes. For example, the polyester resin may be prepared by performing a polymerization reaction at 180° C. to 230° C., optionally while removing water and alcohol produced during condensation from the reaction system under reduced pressure. If any starting monomer is insoluble or immiscible at the reaction temperature, it may be dissolved using a high-boiling solvent as a solubilizer. In this case, the polycondensation reaction is performed while distilling off the solubilizer. If a copolymerization reaction is performed using a poorly immiscible monomer, it may be condensed with an acid or alcohol to be polycondensed therewith before being polycondensed with the major ingredients.

Crystalline Polyester Resin

Examples of crystalline polyester resins include polycondensates of polycarboxylic acids with polyhydric alcohols. The crystalline polyester resin may be either obtained commercially or synthesized.

The crystalline polyester resin may be prepared from linear aliphatic polymerizable monomers, rather than from aromatic polymerizable monomers, to facilitate the formation of a crystalline structure.

Examples of polycarboxylic acids include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids such as phthalic acid, isophthalic acid, terephthalic acid, and naphthalene-2,6-dicarboxylic acid), and anhydrides and lower (e.g., $C_1$-$C_5$) alkyl esters thereof.

These dicarboxylic acids may be used in combination with bridged or branched carboxylic acids having a functionality of three or more. Examples of tricarboxylic acids include aromatic carboxylic acids (e.g., 1,2,3-benzenetricarboxylic acid, 1,2,4-benzenetricarboxylic acid, and 1,2,4-naphthalenetricarboxylic acid) and anhydrides and lower (e.g., $C_1$-$C_5$) alkyl esters thereof.

These dicarboxylic acids may be used in combination with dicarboxylic acids having a sulfonic acid group and dicarboxylic acids having an ethylenic double bond.

These polycarboxylic acids may be used alone or in combination.

Examples of polyhydric alcohols include aliphatic diols (e.g., linear aliphatic diols having 7 to 20 main-chain carbon atoms). Examples of aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosadecanediol. For example, 1,8-octanediol, 1,9-nonanediol, or 1,10-decanediol may be used.

These diols may be used in combination with bridged or branched alcohols having a functionality of three or more. Examples of alcohols having a functionality of three or more include glycerol, trimethylolethane, trimethylolpropane, and pentaerythritol.

These polyhydric alcohols may be used alone or in combination.

These aliphatic diols are preferably present in an amount of 80 molar percent or more, more preferably 90 molar percent or more, of the polyhydric alcohol.

For example, for reasons of fixing properties, the crystalline polyester resin preferably contains at least one of an aliphatic saturated polyhydric alcohol having an alkylene group of 6 to 14 carbon atoms (more preferably 6 to 12 carbon atoms, even more preferably 6 to 10 carbon atoms) and an aliphatic saturated polycarboxylic acid having an alkylene group of 6 to 14 carbon atoms (more preferably 6 to 12 carbon atoms, even more preferably 6 to 10 carbon atoms) in an amount of 30% or more (more preferably 30% to 50%, even more preferably 40% to 50%) of the total mass of the monomers.

The crystalline polyester resin preferably has a melting temperature of 50° C. to 100° C. or about 50° C. to about 100° C., more preferably 55° C. to 90° C. or about 55° C. to about 90° C., even more preferably 60° C. to 85° C. or about 60° C. to about 85° C.

The melting temperature may be determined from a DSC curve obtained by DSC as the melting peak temperature defined in the "Determination of Melting Temperature" section of JIS K 7121-1987 "Testing Methods for Transition Temperatures of Plastics".

The crystalline polyester resin may have a weight average molecular weight (Mw) of 6,000 to 35,000 or about 6,000 to about 35,000.

The crystalline polyester resin may be prepared by known processes such as those used for preparing the polyester resin.

The binder resin is preferably present in an amount of, for example, 40% to 95% or about 40% to about 95%, more preferably 50% to 90% or about 50% to about 90%, even more preferably 60% to 85% or about 60% to about 85%, of the total mass of the toner particles.

Styrene-(Meth)Acrylic Resin

The styrene-(meth)acrylic resin is a copolymer of at least a monomer having a styrene backbone and a monomer having a (meth)acryloyl backbone.

The term "(meth)acrylic" encompasses both acrylic and methacrylic.

Examples of monomers having a styrene backbone (hereinafter also referred to as "styrene monomers") include styrene, alkyl-substituted styrenes (e.g., α-methylstyrene, 2-methylstyrene, 3-methylstyrene, 4-methylstyrene, 2-ethylstyrene, 3-ethylstyrene, and 4-ethylstyrene), halogen-substituted styrenes (e.g., 2-chlorostyrene, 3-chlorostyrene, and 4-chlorostyrene), and vinylnaphthalene. These styrene monomers may be used alone or in combination.

For example, styrene may be used because of its ease of reaction, ease of reaction control, and availability.

Examples of monomers having a (meth)acryloyl backbone (hereinafter also referred to as "(meth)acrylic monomers") include (meth)acrylic acid and (meth)acrylates. Examples of (meth)acrylates include alkyl (meth)acrylates (e.g., methyl (meth)acrylate, ethyl (meth)acrylate, n-propyl (meth)acrylate, n-butyl (meth)acrylate, n-pentyl (meth)acrylate, n-hexyl acrylate, n-heptyl (meth)acrylate, n-octyl (meth)acrylate, n-decyl (meth)acrylate, n-dodecyl (meth) acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth) acrylate, isoheptyl (meth)acrylate, isooctyl (meth)acrylate, 2-ethylhexyl (meth)acrylate, cyclohexyl (meth)acrylate, and t-butylcyclohexyl (meth)acrylate), aryl (meth)acrylates (e.g., phenyl (meth)acrylate, biphenyl (meth)acrylate, diphenylethyl (meth)acrylate, t-butylphenyl (meth)acrylate, and terphenyl (meth)acrylate), dimethylaminoethyl (meth)acrylate, diethylaminoethyl (meth)acrylate, methoxyethyl (meth)acrylate, 2-hydroxyethyl (meth)acrylate, β-carboxyethyl (meth)acrylate, and (meth)acrylamide. These (meth) acrylic monomers may be used alone or in combination.

The ratio (by mass) of the styrene monomer to the (meth)acrylic monomer (styrene monomer/(meth)acrylic monomer) for copolymerization may be, for example, 85/15 to 70/30 or about 85/15 to about 70/30.

To control the surface presence rate of the styrene-(meth) acrylic resin to 5 to 25 atomic percent or about 5 to about 25 atomic percent, β-carboxyethyl acrylate (β-CEA) may be present as the (meth)acrylic monomer. β-CEA may be present in an amount of 0.05% to 1% of the total mass of the (meth)acrylic monomer.

The styrene-(meth)acrylic resin may be crosslinked to further reduce color spots and streaks when images are formed at high temperature and humidity. Examples of crosslinked styrene-(meth)acrylic resins include crosslinked copolymers of at least a monomer having a styrene backbone, a monomer having a (meth)acryloyl backbone, and a crosslinking monomer.

Examples of crosslinking monomers include crosslinking agents having a functionality of two or more.

Examples of difunctional crosslinking agents include divinylbenzene, divinylnaphthalene, di(meth)acrylates (e.g., diethylene glycol di(meth)acrylate, methylenebis(meth) acrylamide, decanediol diacrylate, and glycidyl (meth)acrylate), polyester di(meth)acrylates, and 2-([1'-methylpropylideneamino]carboxyamino)ethyl methacrylate.

Examples of polyfunctional crosslinking agents include tri(meth)acrylates (e.g., pentaerythritol tri(meth)acrylate, trimethylolethane tri(meth)acrylate, and trimethylolpropane tri(meth)acrylate), tetra(meth)acrylates (e.g., tetramethylolmethane tetra(meth)acrylate and oligoester (meth)acrylates), 2,2-bis(4-methacryloxypolyethoxyphenyl)propane, diallyl phthalate, triallyl cyanurate, triallyl isocyanurate, triallyl trimellitate, and diallyl chlorendate.

The ratio (by mass) of the crosslinking monomer to all monomers (crosslinking monomer/all monomers) for copolymerization may be, for example, 2/1,000 to 30/1,000.

For reasons of fixing properties, the styrene-(meth)acrylic resin preferably has a glass transition temperature (Tg) of, for example, 50° C. to 75° C. or about 50° C. to about 75° C., more preferably 55° C. to 65° C. or about 55° C. to about 65° C., even more preferably 57° C. to 60° C. or about 57° C. to about 60° C.

The glass transition temperature (Tg) of the styrene-(meth)acrylic resin may be determined by the same method as the glass transition temperature of the polyester resin.

For reasons of storage stability, the styrene-(meth)acrylic resin preferably has a weight average molecular weight of, for example, 30,000 to 200,000 or about 30,000 to about 200,000, more preferably 40,000 to 100,000 or about 40,000 to about 100,000, even more preferably 50,000 to 80,000 or about 50,000 to about 80,000.

The weight average molecular weight of the styrene-(meth)acrylic resin may be determined by the same method as the weight average molecular weight of the polyester resin.

To further reduce color spots and streaks, the styrene-(meth)acrylic resin is preferably present in an amount of, for example, 10% to 30% by mass, more preferably 12% to 28% by mass, even more preferably 15% to 25% by mass, of the toner particles.

To further reduce color spots and streaks, the styrene-(meth)acrylic resin used in the toner according to this exemplary embodiment preferably contains an alkyl (meth) acrylate having an alkyl group of 2 to 8 carbon atoms (more preferably 4 to 8 carbon atoms) in an amount of 20% or more (more preferably 20% to 40%, even more preferably 20% to 35%) of the total mass of the monomers.

If β-CEA is present as the (meth)acrylic monomer, β-CEA is excluded from alkyl (meth)acrylates.

For the same reason, the styrene-(meth)acrylic resin may be used in combination with a binder resin containing a crystalline polyester resin.

Examples of crystalline polyester resins include those containing at least one of an aliphatic saturated polyhydric alcohol having an alkylene group of 6 to 14 carbon atoms (preferably 6 to 12 carbon atoms, more preferably 6 to 10 carbon atoms) and an aliphatic saturated polycarboxylic acid having an alkylene group of 6 to 14 carbon atoms (preferably 6 to 12 carbon atoms, more preferably 6 to 10 carbon atoms) in an amount of 30% or more (preferably 30% to 50%, more preferably 40% to 50%) of the total mass of the monomers.

Release Agent

Non-limiting examples of release agents include hydrocarbon waxes; natural waxes such as carnauba wax, rice wax, and candelilla wax; synthetic, mineral, and petroleum waxes such as montan wax; and ester waxes such as fatty acid esters and montanic acid esters.

These release agents may be used alone or in combination.

For example, hydrocarbon waxes (waxes having a hydrocarbon backbone) may be used because of their affinity for the styrene-(meth)acrylic resin. Examples of hydrocarbon waxes include Fischer-Tropsch wax, polyethylene waxes (waxes having a polyethylene backbone), polypropylene waxes (waxes having a polypropylene backbone), paraffin waxes (waxes having a paraffin backbone), and microcrystalline wax.

The hydrocarbon wax, if used, is preferably present in an amount of 85% to 100% or about 85% to about 100%, more preferably 95% to 100% or about 95% to about 100%, even more preferably 100% or about 100%, of the total mass of the release agent.

The release agent preferably has a melting temperature of 50° C. to 110° C. or about 50° C. to about 110° C., more preferably 60° C. to 100° C. or about 60° C. to about 100° C.

The melting temperature may be determined from a DSC curve obtained by DSC as the melting peak temperature defined in the "Determination of Melting Temperature" section of JIS K 7121-1987 "Testing Methods for Transition Temperatures of Plastics".

The release agent is preferably present in an amount of, for example, 1% to 20% or about 1% to about 20%, more preferably 5% to 15% or about 5% to about 15%, of the total mass of the toner particles.

Colorant

Examples of colorants include various pigments such as carbon black, chrome yellow, hansa yellow, benzidine yellow, threne yellow, quinoline yellow, pigment yellow, permanent orange GTR, pyrazolone orange, vulcan orange, watching red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

These colorants may be used alone or in combination.

Optionally, the colorant may be surface-treated or used in combination with dispersants. The colorant may be a combination of different colorants.

The colorant is preferably present in an amount of, for example, 1% to 30%, more preferably 3% to 15%, of the total mass of the toner particles.

Other Additives

Examples of other additives include known additives such as magnetic materials, charge control agents, and inorganic powders. These additives serve as internal additives in the toner particles.

Properties of Toner Particles

The toner particles may be single-layer toner particles or core-shell toner particles including a core (core particle) and a coating (shell layer) covering the core.

For example, the toner particles may be core-shell toner particles including a core containing a binder resin and other optional additives such as colorants and release agents and a coating containing a binder resin.

The toner particles preferably have a volume average particle size (D50v) of 2 to 10 μm, more preferably 4 to 8 μm.

The various average particle sizes and particle size distribution indices of the toner particles may be determined on a Coulter Multisizer II (Beckman Coulter, Inc.) using Isoton-II (Beckman Coulter, Inc.) as an electrolyte.

For measurement, 0.5 to 50 mg of a test sample is added to 2 mL of a 5% aqueous solution of a surfactant (e.g., sodium alkylbenzenesulfonate) serving as a dispersant. The mixture is added to 100 to 150 mL of the electrolyte.

The sample suspended in the electrolyte is dispersed using a sonicator for 1 minute. The particle size distribution of particles having particle sizes of 2 to 60 μm is determined on a Coulter Multisizer II using an aperture with an aperture size of 100 μm. A total of 50,000 particles are sampled.

The resulting particle size distribution is divided into particle size classes (channels). Cumulative volume and number distributions are drawn from smaller particle sizes. The volume particle size D16v is defined as the particle size at which the cumulative volume is 16%. The number particle size D16p is defined as the particle size at which the cumulative number is 16%. The volume average particle size D50v is defined as the particle size at which the cumulative volume is 50%. The number average particle size D50p is defined as the particle size at which the cumulative number is 50%. The volume particle size D84v is defined as the particle size at which the cumulative volume is 84%. The number particle size D84p is defined as the particle size at which the cumulative number is 84%.

From these particle sizes, the volume average particle size distribution index (GSDv) is calculated as $(D84v/D16v)^{1/2}$, and the number average particle size distribution index (GSDp) is calculated as $(D84p/D16p)^{1/2}$.

The toner particles preferably have a shape factor SF1 of 110 to 150, more preferably 120 to 140.

The shape factor SF1 may be calculated by the following equation:

$$SF1=(ML^2/A)\times(n/4)\times 100$$

where ML is the absolute maximum length of the toner particles, and A is the projected area of the toner particles.

Typically, the shape factor SF1 is numerically determined by analyzing a microscope image or a scanning electron microscope (SEM) image using an image analyzer. Specifically, the shape factor SF1 may be determined as follow. A light microscope image of particles dispersed over a surface of a glass slide is captured into a Luzex image analyzer with a video recorder. The maximum lengths and projected areas of 100 particles are determined and are substituted into the above equation to calculate the shape factors SF1 of the individual particles, and the average shape factor SF1 is calculated.

In the toner according to this exemplary embodiment, 70% or more or about 70% or more of the release agent is present within 800 nm or about 800 nm from the surfaces of the toner particles (i.e., the presence rate of the release agent is 70% or more or about 70% or more). To further reduce color spots and streaks, the presence rate of the release agent is preferably 75% to 100% or about 75% to about 100%, more preferably 80% to 100% or about 80% to about 100%.

In the toner according to this exemplary embodiment, the styrene-(meth)acrylic resin is present in an amount of 5 to 25 atomic percent or about 5 to about 25 atomic percent of the resin components in the surfaces of the toner particles as determined by XPS (i.e., the surface presence rate of the styrene-(meth)acrylic resin is 5 to 25 atomic percent or about 5 to about 25 atomic percent). To further reduce color spots and streaks, the surface presence rate of the styrene-(meth)acrylic resin is preferably 5 to 20 atomic percent or about 5 to about 20 atomic percent, more preferably 5 to 15 atomic percent or about 5 to about 15 atomic percent.

In this exemplary embodiment, the surface presence rate of the styrene-(meth)acrylic resin may be controlled by any method. For example, if core-shell particles including a core (core particle) and a coating (shell layer) covering the core are formed by a wet process, one method is to mix styrene-(meth)acrylic resin particles in the coating. Other methods include controlling the particle size of the styrene-(meth) acrylic resin particles to be mixed in the coating, controlling the amount of carboxy groups on the surfaces of the styrene-(meth)acrylic resin particles, and controlling the pH level at the start of a coalescence step.

Although the surface presence rate of the styrene-(meth) acrylic resin may be controlled by controlling the amount of carboxy groups on the surfaces of the styrene-(meth)acrylic resin particles in this exemplary embodiment, it may also be controlled by other methods. The amount of carboxy groups on the surfaces of the styrene-(meth)acrylic resin particles may be controlled, for example, by changing the amount of β-CEA present as the (meth)acrylic monomer.

The presence rate of the release agent and the surface presence rate of the styrene-(meth)acrylic resin may be determined as follows.

Toner particles under measurement are mixed and embedded in epoxy resin, and the epoxy resin is cured. The resulting cured resin is sliced into a sample section having a thickness of 80 to 130 nm using an ultramicrotome (Ultracut UCT, Leica Microsystems). The resulting sample section is stained with ruthenium tetroxide in a desiccator at 30° C. for 3 hours. An SEM image of the stained sample section is captured under a super-resolution field-emission scanning electron microscope (FE-SEM, e.g., S-4800, Hitachi High-Technologies Corporation). The release agent, the styrene-(meth)acrylic resin, and the styrene-(meth) acrylic resin are distinguished by the density depending on the degree of staining since they are more easily stained with ruthenium tetroxide in the above order. If the density is difficult to determine, for example, depending on the sample condition, the staining time is adjusted.

If the toner particles contain a colorant, the colorant domains in the sections of the toner particles are distinguished by size since they are smaller than the release agent domains and the styrene-(meth)acrylic resin domains.

Toner particle sections having a maximum length larger than or equal to 85% of the volume average particle size of the toner particles are selected from the above SEM image. The stained release agent domains are observed to determine the area of the release agent in the entire toner particles and the area of the release agent present within 800 nm or about 800 nm from the surfaces of the toner particles. The ratio of both areas (area of release agent present within 800 nm or about 800 nm from surfaces of toner particles/area of release agent in entire toner particles) is calculated. This ratio is calculated for 100 randomly selected toner particles, and the average ratio is calculated to obtain the presence rate of the release agent.

The reason for selecting toner particle sections having a maximum length larger than or equal to 85% of the volume average particle size of the toner particles is as follows. Whereas the toner particles are three-dimensional, the SEM image is a cross-section; therefore, the ends of the toner particles may be cut in the SEM image. Such end cross-sections do not reflect the release agent domains of the toner particles.

The surface presence rate of the styrene-(meth)acrylic resin is determined by XPS. XPS is performed using a JEOL JPS-9000MX instrument. The X-ray source is Mg-Kα. The acceleration voltage is 10 kV. The emission current is 30 mA.

The C1s spectrum of the surfaces of the toner particles under measurement is obtained under the above conditions. The amount of styrene-(meth)acrylic resin present in the surfaces of the toner particles is determined by separating the peaks attributed to the styrene-(meth)acrylic resin in the surfaces of the toner particles from the C1s spectrum. The individual peaks in the C1s spectrum are separated by least squares curve fitting. The component spectra used as the basis for separation are separately obtained C1s spectra of the styrene-(meth)acrylic resin, crystalline polyester resin, and polyester resin used for the preparation of the toner particles. The surface presence rate of the styrene-(meth) acrylic resin is calculated based on the amount of resin component determined by peak separation.

External Additive

Examples of external additives include inorganic particles. Examples of inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

The surfaces of the inorganic particles used as the external additive may be subjected to hydrophobic treatment. The hydrophobic treatment may be performed, for example, by immersing the inorganic particles in a hydrophobic agent. Non-limiting examples of hydrophobic agents include silane coupling agents, silicone oil, titanate coupling agents, and aluminum coupling agents. These hydrophobic agents may be used alone or in combination.

The hydrophobic agent is typically used in an amount of, for example, 1 to 10 parts by mass per 100 parts by mass of the inorganic particles.

Other examples of external additives include resin particles (e.g., resin particles such as polystyrene, polymethyl methacrylate (PMMA), and melamine resin particles) and cleaning active agents (e.g., higher fatty acid metal salt particles, such as zinc stearate particles, and fluoropolymer particles).

The external additive is preferably present in an amount of, for example, 0.01% to 5% by mass or about 0.01% to about 5% by mass, more preferably 0.01% to 2.0% by mass or about 0.01% to about 2.0% by mass, of the toner particles.

To further reduce color spots and streaks, the external additive preferably contains titanium oxide ($TiO_2$) particles having a number average particle size of 10 to 80 nm or about 10 to about 80 nm. For the same reason, the titanium oxide particles more preferably have a number average particle size of 20 to 50 nm or about 20 to about 50 nm. An external additive containing such titanium oxide particles may adhere more strongly to the surfaces of the toner particles because of their shape, for example, than an external additive containing only silica ($SiO_2$) particles. The adhesion of the titanium oxide particles having the above particle size to the surfaces of the toner particles may produce a filler effect, thereby improving the toner strength. This may reduce excessive exposure of the release agent when a mechanical load (stress) is applied.

The number average particle size of the titanium oxide particles may be determined as follows.

An image of titanium oxide particles is captured at 10,000× magnification under a super-resolution FE-SEM (e.g., S-4800, Hitachi High-Technologies Corporation). A hundred primary particles are observed, and the circle equivalent diameters of the primary particles are determined by image analysis. The average circle equivalent diameter is then calculated to obtain the number average particle size of the titanium oxide particles.

Examples of titanium oxide particles include anatase titanium oxide, rutile titanium oxide, and metatitanate particles.

The titanium oxide particles may be subjected to hydrophobic treatment. The hydrophobic treatment may be performed, for example, by immersing titania particles in a hydrophobic agent. Examples of hydrophobic agents for use in the hydrophobic treatment include silane coupling agents and silicone oil.

Examples of silane coupling agents include hexamethyldisilazane, trimethylsilane, trimethylchlorosilane, dimethyldichlorosilane, methyltrichlorosilane, allyldimethylchlorosilane, benzyldimethylchlorosilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-butyltrimethoxysilane, n-hexadecyltrimethoxysilane, n-octadecyltrimethoxysilane, vinyltrimethoxysilane, vinyltriethoxysilane, 7-methacryloxypropyltrimethoxysilane, and vinyltriacetoxysilane.

The hydrophobic agent is typically used in an amount of, for example, 1 to 10 parts by mass per 100 parts by mass of the inorganic particles.

The titanium oxide particles used as the external additive are preferably present in an amount of, for example, 0.01% to 5% by mass or about 0.01% to about 5% by mass, more preferably 0.01% to 2.0% by mass or about 0.01% to about 2.0% by mass, of the toner particles.

Titanium oxide particles having a number average particle size of 10 to 80 nm may be used as the external additive alone (i.e., all external additive is titanium oxide) or in combination with other external additives (e.g., silica particles).

Method for Manufacturing Toner

A method for manufacturing the toner according to this exemplary embodiment will now be described.

The toner according to this exemplary embodiment may be manufactured by manufacturing toner particles and adding an external additive to the toner particles.

The toner particles may be manufactured either by dry processes (e.g., pulverization) or by wet processes (e.g., aggregation coalescence, suspension polymerization, and dissolution suspension). The toner particles may be manufactured by any process, including known processes.

For example, the toner particles may be manufactured by aggregation coalescence.

Specifically, if the toner particles are manufactured by aggregation coalescence, they may be manufactured, for example, by the steps of:

providing a polyester resin particle dispersion in which polyester resin particles are dispersed (polyester-resin-particle-dispersion providing step);

providing a styrene-(meth)acrylic resin particle dispersion in which styrene-(meth)acrylic resin particles are dispersed (styrene-(meth)acrylic-resin-particle-dispersion providing step);

providing a release agent particle dispersion in which release agent particles are dispersed (release-agent-particle-dispersion providing step);

mixing the two resin particle dispersions (and optionally other particle dispersions such as colorant particle dispersions) and aggregating the resin particles (and optionally other particles) in the mixed dispersion to form first aggregated particles (first-aggregated-particle forming step);

mixing the first aggregated particle dispersion in which the first aggregated particles are dispersed, the polyester resin particle dispersion, and the release agent particle dispersion and aggregating the polyester resin particles and the release agent particles on the surfaces of the first aggregated particles to form second aggregated particles (second-aggregated-particle forming step); and heating the second aggregated particle dispersion in which the second aggregated particles are dispersed to coalesce the second aggregated particles, thereby forming toner particles (coalescing step).

The individual steps of the aggregation coalescence process will now be described in greater detail. Although a method for manufacturing toner particles containing a colorant will be described below, the colorant is optional. It should be understood that additives other than colorants may also be used.

Resin-Particle-Dispersion Providing Steps

The process begins by providing a resin particle dispersion in which polyester resin particles serving as a binder resin are dispersed, a styrene-(meth)acrylic resin particle dispersion in which styrene-(meth)acrylic resin particles are dispersed, a colorant particle dispersion in which colorant particles are dispersed, and a release agent particle dispersion in which release agent particles are dispersed.

The polyester resin particle dispersion may be prepared, for example, by dispersing polyester resin particles in a dispersion medium with a surfactant.

Examples of dispersion media for use in the polyester resin particle dispersion include aqueous media.

Examples of aqueous media include water, such as distilled water and ion exchange water, and alcohols. These aqueous media may be used alone or in combination.

Examples of surfactants include anionic surfactants such as sulfate ester salts, sulfonate salts, phosphate esters, and soaps; cationic surfactants such as amine salts and quaternary ammonium salts; and nonionic surfactants such as polyethylene glycol, alkylphenol-ethylene oxide adducts, and polyhydric alcohols. For example, anionic and cationic surfactants may be used. Nonionic surfactants may be used in combination with anionic and cationic surfactants.

These surfactants may be used alone or in combination.

The polyester resin particles may be dispersed in the dispersion medium, for example, by common dispersion processes using machines such as rotary shear homogenizers and media mills such as ball mills, sand mills, and Dyno-Mills. Alternatively, the polyester resin particles may be dispersed in the dispersion medium by phase-inversion emulsification. In phase-inversion emulsification, the resin to be dispersed is dissolved in a hydrophobic organic solvent in which the resin is soluble. After the organic continuous phase (O-phase) is neutralized with a base, an aqueous medium (W-phase) is added to cause phase inversion from water-in-oil (W/O) to oil-in-water (O/W), thereby dispersing the resin in the form of particles in the aqueous medium.

The polyester resin particles dispersed in the polyester resin particle dispersion preferably have a volume average particle size of, for example, 0.01 to 1 μm, more preferably 0.08 to 0.8 μm, even more preferably 0.1 to 0.6 μm.

The volume average particle size of the polyester resin particles may be determined as follows. A particle size distribution is obtained using a laser diffraction particle size distribution analyzer (e.g., LA-700, Horiba, Ltd.) and is divided into particle size classes (channels). A cumulative volume distribution is drawn from smaller particle sizes. The volume average particle size D50v is determined as the particle size at which the cumulative volume is 50% of all particles. The volume average particle sizes of particles dispersed in other dispersions may also be determined in the same manner.

The polyester resin particles are preferably present in the polyester resin particle dispersion in an amount of 5% to 50% by mass, more preferably 10% to 40% by mass.

The styrene-(meth)acrylic resin particle dispersion, the colorant particle dispersion, and the release agent particle dispersion may be prepared in the same manner as the polyester resin particle dispersion. That is, the dispersion medium, dispersion process, volume average particle size, and amount of particles of the styrene-(meth)acrylic resin particle dispersion, the colorant particle dispersion, and the release agent particle dispersion may be similar to those of the polyester resin particle dispersion.

First-Aggregated-Particle Forming Step

The polyester resin particle dispersion, the styrene-(meth) acrylic resin particle dispersion, and the colorant particle dispersion are mixed together.

The polyester resin particles, the styrene-(meth)acrylic resin particles, and the colorant particles are subjected to heteroaggregation in the mixed dispersion to form first aggregated particles including the polyester resin particles, the styrene-(meth)acrylic resin particles, and the colorant particles. The first aggregated particles are close in size to the target toner particles.

Optionally, the release agent particle dispersion may also be mixed together to form first aggregated particles including the release agent particles.

Specifically, the first aggregated particles may be formed, for example, by adding a coagulant to the mixed dispersion, adjusting the mixed dispersion to an acidic pH (e.g., a pH of 2 to 5), optionally adding a dispersion stabilizer, and heating the mixed dispersion to aggregate the particles dispersed therein. The mixed dispersion is heated to a temperature close to the glass transition temperature of the polyester resin (e.g., 10° C. to 30° C. lower than the glass transition temperature of the polyester resin).

For example, the first-aggregated-particle forming step may be performed by adding a coagulant to the mixed dispersion at room temperature (e.g., 25° C.) with stirring using a rotary shear homogenizer, adjusting the mixed dispersion to an acidic pH (e.g., a pH of 2 to 5), optionally adding a dispersion stabilizer, and heating the mixed dispersion.

Examples of coagulants include surfactants of opposite polarity to the surfactant present in the mixed dispersion, inorganic metal salts, and metal complexes with a valence of two or more. The use of metal complexes as the coagulant may allow for a reduction in the amount of surfactant used to improve the charging characteristics.

The coagulant may be used in combination with additives that form a complex or a similar linkage with metal ions of the coagulant. Examples of such additives include chelating agents.

Examples of inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

The chelating agent may be a water-soluble chelating agent. Examples of chelating agents include oxycarboxylic acids such as tartaric acid, citric acid, and gluconic acid; and aminocarboxylic acids such as iminodiacetic acid (IDA), nitrilotriacetic acid (NTA), and ethylenediaminetetraacetic acid (EDTA).

The chelating agent is preferably present in an amount of, for example, 0.01 to 5.0 parts by mass, more preferably 0.1 to less than 3.0 parts by mass, per 100 parts by mass of the resin particles.

Second-Aggregated-Particle Forming Step

After the preparation of the first aggregated particle dispersion in which the first aggregated particles are dispersed, the first aggregated particle dispersion, the polyester resin particle dispersion, and the release agent particle dispersion are mixed together. The polyester resin particle dispersion and the release agent particle dispersion may be mixed in advance before the mixture is mixed with the first aggregated particle dispersion.

In the mixed dispersion in which the first aggregated particles, the polyester resin particles, and the release agent particles are dispersed, the polyester resin particles and the release agent particles are aggregated on the surfaces of the first aggregated particles to form second aggregated particles.

For example, when the first aggregated particles reach the target particle size in the first-aggregated-particle forming step, the first aggregated particle dispersion is mixed with a dispersion in which the polyester resin particles and the release agent particles are dispersed. The mixed dispersion is heated below the glass transition temperature of the polyester resin and is adjusted to a pH of, for example, about 6.5 to about 8.5 to terminate aggregation.

The polyester resin particles and the release agent particles are thus aggregated on the surfaces of the second aggregated particles to form second aggregated particles.

Coalescing Step

The second aggregated particle dispersion in which the second aggregated particles are dispersed is heated, for example, at or above the glass transition temperature of the polyester resin (e.g., 10° C. to 30° C. higher than the glass transition temperature of the polyester resin) to coalesce the second aggregated particles, thereby forming toner particles.

After the above steps, toner particles are obtained.

Upon completion of the coalescing step, the toner particles formed in the dispersion are subjected to known washing, solid-liquid separating, and drying steps to obtain dry toner particles.

In the washing step, the toner particles may be sufficiently washed by displacement washing with ion exchange water for reasons of charging characteristics. Although the solid-liquid separating step may be performed by any process, processes such as suction filtration and pressure filtration may be used for reasons of productivity. Although the drying step may be performed by any process, processes such as freeze drying, flush jet drying, fluidized bed drying, and vibrating fluidized bed drying may be used for reasons of productivity.

The toner according to this exemplary embodiment may be manufactured, for example, by mixing the resulting dry toner particles with an external additive. The mixing may be performed, for example, using machines such as V-blenders, Henschel mixers, and Loedige mixers. Optionally, coarse toner particles may be removed using machines such as vibrating screens and air screens.

Electrostatic Image Developer

An electrostatic image developer according to an exemplary embodiment of the present invention contains at least the toner according to the above exemplary embodiment.

The electrostatic image developer according to this exemplary embodiment may be a one-component developer containing only the toner according to the above exemplary embodiment or a two-component developer containing the toner and a carrier.

The carrier may be any carrier, including known carriers. Examples of carriers include coated carriers made of a magnetic powder used as cores and coated with a coating resin, magnetic-powder-dispersed carriers made of a matrix resin in which a magnetic powder is dispersed, and resin-impregnated carriers made of a porous magnetic powder impregnated with a resin.

The constituent particles of the magnetic-powder-dispersed carriers and the resin-impregnated carriers may be used as cores and coated with a coating resin.

Examples of magnetic powders include magnetic metal powders such as iron, nickel, and cobalt powders and magnetic oxide powders such as ferrite and magnetite powders.

Examples of coating resins and matrix resins include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylic acid copolymers, straight silicone resins containing organosiloxane bonds and modified products thereof, fluoropolymers, polyesters, polycarbonates, phenolic resins, and epoxy resins.

The coating resin and the matrix resin may contain additives such as conductive particles.

Examples of conductive particles include metal particles such as gold, silver, and copper particles and other particles such as carbon black, titanium oxide, zinc oxide, tin oxide, barium sulfate, aluminum borate, and potassium titanate particles.

The cores may be coated with the coating resin, for example, by dissolving the coating resin and optionally various additives in a suitable solvent and coating the cores with the resulting coating solution. The solvent may be any solvent selected depending on, for example, the coating resin used and the suitability for coating.

Examples of resin coating processes include dipping, in which the cores are dipped in the coating solution, spraying, in which the cores are sprayed with the coating solution, fluidized bed coating, in which the cores are sprayed with the coating solution while being suspended in air stream, and kneader coating, in which the carrier cores and the coating solution are mixed in a kneader coater and the solvent is then removed.

To further reduce color spots and streaks, the carrier preferably has a shape factor SF2 of 100 to 120 or about 100 to about 120, more preferably 100 to 115 or about 100 to about 115, even more preferably 100 to 110 or about 100 to about 110. A carrier having a shape factor SF2 within the above ranges is spherical or nearly spherical.

If the carrier has a shape factor SF2 within the above ranges and is thus spherical or nearly spherical, the toner may roll easily over the surfaces of the carrier particles. This may reduce the mechanical load on the toner in the developing device and may thus reduce excessive exposure of the release agent in the surfaces of the toner particles.

The shape factor SF2 of the carrier may be controlled, for example, depending on the firing conditions of the magnetic powder, the granulation conditions of the magnetic-powder-dispersed particles that form the magnetic-powder-dispersed carrier, which is made of a matrix resin in which a magnetic powder is dispersed, and the thickness of the coating on the magnetic powder or the magnetic-powder-dispersed particles.

The shape factor SF2 of the carrier may be determined, for example, as follows.

The carrier is observed under an SEM (e.g., S-4100, Hitachi High-Technologies Corporation), and an image thereof is captured into an image analyzer (e.g., Luzex III, Nireco Corporation). The shape factors SF2 of 100 carrier particles are calculated by the following equation:

$$\text{Shape factor SF2}=PM^2/(4\cdot A\cdot\pi)\times 100$$

where PM is the perimeter of the carrier particles, A is the projected area of the carrier particles, and $\pi$ is the circular constant. The average shape factor SF2 is calculated to obtain the shape factor SF2 of the carrier. The magnification of the electron microscope is adjusted such that 3 to 20 external additive particles are shown in one field of view. The carrier is observed in multiple fields of view, and the shape factor SF2 is calculated by the above equation.

To further reduce color spots and streaks, the carrier may be a magnetic-powder-dispersed carrier containing magnetic-powder-dispersed particles made of a matrix resin in which a magnetic powder is dispersed. For the same reason, the carrier may be a magnetic-powder-dispersed carrier having a shape factor SF2 of 100 to 120 or about 100 to about 120. The use of magnetic-powder-dispersed carriers, which have lower specific gravities than, for example, ferrite carriers, may reduce the mechanical load (stress) on the electrostatic image developer and may thus reduce excessive exposure of the release agent in the surfaces of the toner particles.

The magnetic-powder-dispersed carrier may contain bare magnetic-powder-dispersed particles for use as magnetic-powder-dispersed carriers or may contain magnetic-powder-dispersed particles used as cores and coated with a coating resin.

Examples of magnetic powders include those mentioned above. Although any magnetic powder may be used, ferrite and magnetite may be used for reasons of stability.

Specific examples of magnetic powders include iron-based oxides such as magnetite, γ-iron oxide, Mn—Zn ferrite, Ni—Zn ferrite, Mn—Mg ferrite, Li ferrite, and Cu—Zn ferrite.

The magnetic powder preferably has a volume average particle size of 0.01 to 1 μm, more preferably 0.03 to 0.5 μm, even more preferably 0.05 to 0.35 μm. The volume average particle size may be determined using a laser diffraction/scattering particle size distribution analyzer (LS 13 320 particle size analyzer, Beckman Coulter, Inc.). The resulting particle size distribution is divided into particle size classes (channels). A cumulative volume distribution is drawn from smaller particle sizes. The volume average particle size D50v is defined as the particle size at which the cumulative volume is 50%.

The mixing ratio (by mass) of the toner to the carrier in the two-component developer is preferably 1:100 to 30:100, more preferably 3:100 to 20:100.

Image-Forming Apparatus and Method

An image-forming apparatus and method according to an exemplary embodiment of the present invention will now be described.

The image-forming apparatus according to this exemplary embodiment includes an image carrier, a charging unit that charges a surface of the image carrier, an electrostatic-image forming unit that forms an electrostatic image on the charged surface of the image carrier, a developing unit that contains an electrostatic image developer and that develops the electrostatic image formed on the surface of the image carrier with the electrostatic image developer to form a toner image, a transfer unit that transfers the toner image from the surface of the image carrier to a surface of a recording medium, a fixing unit that fixes the toner image to the surface of the recording medium, a cleaning unit that removes residual toner from the surface of the image carrier, and a toner supply unit that supplies the removed toner to the developing unit. The electrostatic image developer is the electrostatic image developer according to the above exemplary embodiment.

The image-forming apparatus according to this exemplary embodiment executes an image-forming method (the image-forming method according to this exemplary embodiment) including a charging step of charging the surface of the image carrier, an electrostatic-image forming step of forming an electrostatic image on the charged surface of the image carrier, a developing step of developing the electrostatic image formed on the surface of the image carrier with the electrostatic image developer to form a toner image, a transfer step of transferring the toner image from the surface of the image carrier to a surface of a recording medium, a fixing step of fixing the toner image to the surface of the recording medium, a cleaning step of removing residual toner from the surface of the image carrier, and a toner supply step of supplying the removed toner to the developing unit.

The image-forming apparatus according to this exemplary embodiment may be a known type of image-forming apparatus. For example, the image-forming apparatus according to this exemplary embodiment may be a direct-transfer image-forming apparatus that transfers a toner image from a surface of an image carrier directly to a recording medium; an intermediate-transfer image-forming apparatus that transfers a toner image from a surface of an image carrier to a surface of an intermediate transfer member and then transfers the toner image from the surface of the intermediate transfer member to a surface of a recording medium; or an image-forming apparatus including an erase unit that erases charge on a surface of an image carrier by irradiation with erase light after the transfer of the toner image and before charging.

If the image-forming apparatus according to this exemplary embodiment is an intermediate-transfer image-forming apparatus, the transfer unit includes, for example, an intermediate transfer member having a surface to which a toner image is transferred, a first transfer unit that transfers the toner image from the surface of the image carrier to the surface of the intermediate transfer member, and a second transfer unit that transfers the toner image from the surface of the intermediate transfer member to a surface of a recording medium.

The image-forming apparatus according to this exemplary embodiment may include, for example, a cartridge structure (process cartridge) including a developing unit and attachable to and detachable from the image-forming apparatus. The process cartridge may include, for example, a developing unit containing the electrostatic image developer according to the above exemplary embodiment (hereinafter also referred to as "developer").

A non-limiting example of the image-forming apparatus according to this exemplary embodiment will now be described. The parts shown in the drawings are described, and other parts are not described.

FIG. 1 is a schematic view of the image-forming apparatus according to this exemplary embodiment.

An image-forming apparatus 300 shown in FIG. 1 includes, for example, a rectangular housing 200 and a sheet tray 204 disposed in the lower part of the housing 200 and containing sheets of recording paper (an example of a recording medium) P. A pickup roller 92 is disposed at one end of an arm that picks a sheet of recording paper P from the sheet tray 204. A roller 94 is disposed at the other end of the arm. A roller 96 is disposed opposite the roller 94.

During image formation, the pickup roller 92 is moved downward depending on the level of the sheets of recording paper P contained in the sheet tray 204. The pickup roller 92 is rotated in contact with the topmost sheet of recording paper P to pick the sheet of recording paper P. The picked sheet of recording paper P is transported to the rollers 94 and 96 and is held and transported between a pair of rollers 82 disposed downstream of the roller 96 in the sheet transport direction. Opposing rollers 84 and 86, a roller 88 that changes the sheet transport direction, and a pair of rollers 90 are arranged downstream of the pair of rollers 82 in the above order in the sheet transport direction.

The image-forming apparatus 300 also includes a cylindrical photoreceptor (an example of an image carrier) 10 that rotates clockwise in the upper part of the housing 200.

A charging roller (an example of a charging unit) 20, an exposure device (an example of an electrostatic-image forming unit) 30, a developing device (an example of a developing unit) 40, a transfer roller (an example of a transfer unit) 52, an erase device (an example of an erase unit) 60, and a cleaning device (an example of a cleaning unit) 70 are arranged clockwise in the above order around the photoreceptor 10. The charging roller 20 is disposed opposite the photoreceptor 10 and charges the surface of the photoreceptor 10 to a predetermined potential. The exposure device 30 exposes the surface of the photoreceptor 10 charged by the charging roller 20 to form an electrostatic image. The developing device 40 supplies a charged toner to the electrostatic image to develop the electrostatic image. The transfer roller 52 is disposed opposite the photoreceptor 10 and transfers the toner image to a sheet of recording paper P. The erase device 60 is disposed opposite the photoreceptor 10 and erases charge on the surface of the photoreceptor 10 by irradiation with erase light after the transfer of the toner image to the sheet of recording paper P. The cleaning device 70 cleans the surface of the photoreceptor 10 to remove residual toner. A supply transport path (an example of a toner supply unit) 74 supplies the removed toner (reclaimed toner) to the developing device 40. The erase device 60 is optional.

The charging roller 20 negatively charges the surface of the photoreceptor 10. The exposure device 30 then forms an electrostatic image on the charged surface of the photoreceptor 10.

The developing device 40 will now be described. The developing device 40 is disposed opposite the photoreceptor 10 in a developing area. The developing device 40 includes, for example, a developing container 41 containing a two-component developer containing a negatively (−) chargeable toner and a positively (+) chargeable carrier. The developing container 41 includes a developing container body 41A and a developing container covering 41B covering the top end thereof.

The interior of the developing container body 41A includes a developing roller chamber 42A accommodating a developing roller 42, a first stirring chamber 43A adjacent to the developing roller chamber 42A, and a second stirring chamber 44A adjacent to the first stirring chamber 43A. The developing roller chamber 42A also accommodates a layer-thickness regulating member 45 that regulates the thickness of the layer of developer on the surface of the developing roller 42 when the developing container covering 41B is attached to the developing container body 41A.

The first stirring chamber 43A and the second stirring chamber 44A are separated by a partition 41C and communicate via openings (not shown) provided at both ends of the partition 41C in the longitudinal direction (in the longitudinal direction of the developing device 40). The first stirring chamber 43A and the second stirring chamber 44A form a circulation stirring chamber (43A+44A).

The developing roller 42 is disposed in the developing roller chamber 42A opposite the photoreceptor 10. The developing roller 42 and the photoreceptor 10 rotate in opposite directions. The developing roller 42 includes a magnetic roller (fixed magnet) and a sleeve disposed around the magnetic roller. The developer present in the first stirring chamber 43A is attracted to the surface of the developing roller 42 by the magnetic force of the magnetic roller. The shaft of the developing roller 42 is rotatably supported by the developing container body 41A.

A bias power supply (not shown) is connected to the sleeve of the developing roller 42. The bias power supply applies, for example, a developing bias including a direct-current (DC) component and an alternating-current (AC) component superimposed thereon.

A first stirring member 43 (stirring transport member) that transports the developer with stirring is disposed in the first stirring chamber 43A. A second stirring member 44 (stirring transport member) that transports the developer with stirring is disposed in the second stirring chamber 44A. The first stirring member 43 includes a first rotating shaft extending along the axis of the developing roller 42 and a stirring transport impeller (protrusion) fixed spirally around the rotating shaft. Similarly, the second stirring member 44 includes a second rotating shaft and a stirring transport impeller (protrusion). The stirring members 43 and 44 are rotatably supported by the developing container body 41A. As the first and second stirring members 43 and 44 rotate, the developer in the first stirring chamber 43A and the developer in the second stirring chamber 44A are transported in opposite directions.

The cleaning device 70 will now be described. The cleaning device 70 includes a housing 71 and a cleaning blade 72 extending from the housing 71. The cleaning blade 72 is plate-shaped and has its leading edge (hereinafter also referred to as "edge") in contact with the photoreceptor 10. The cleaning blade 72 is disposed downstream of the position where the transfer roller 52 transfers a toner image from the photoreceptor 10 in the rotational direction (clockwise) and downstream of the position where the erase device 60 erases charge on the photoreceptor 10 in the rotational direction.

As the photoreceptor 10 rotates clockwise, the cleaning blade 72 collects foreign substances such as toner remaining on the surface of the photoreceptor 10 without being transferred to sheets of recording paper P and paper dust produced from sheets of recording paper P and removes them from the photoreceptor 10.

The cleaning blade 72 may be made of a known material such as urethane rubber, silicone rubber, fluoroelastomer, chloroprene rubber, or butadiene rubber. For example, polyurethane may be used because of its good wear resistance.

A transport member 73 is disposed at the bottom of the housing 71. One end of the supply transport path 74 is connected to the housing 71 downstream of the transport member 73 in the transport direction to supply the toner (developer) removed by the cleaning blade 72 to the developing device 40. The other end of the supply transport path 74 is connected to the developing device 40 (second stirring chamber 44A).

As the transport member 73 disposed at the bottom of the housing 71 rotates, the toner removed by the cleaning blade 72 is supplied from the cleaning device 70 through the supply transport path 74 to the developing device 40 (second stirring chamber 44A). The reclaimed toner supplied to the second stirring chamber 44A is stirred together with the toner contained in the second stirring chamber 44A and is reused. The image-forming apparatus 300 has a toner reclaim system for the reuse of reclaimed toner. The developing device 40 is also supplied with toner from a toner cartridge 46 through a toner supply tube (not shown).

A sheet of recording paper P transported to the position where the transfer roller 52 is disposed opposite the photoreceptor 10 is pressed against the photoreceptor 10 by the transfer roller 52 to transfer a toner image from the outer surface of the photoreceptor 10 to the sheet of recording paper P. A fixing device (an example of a fixing unit) including a fixing roller 100 and a roller 102 disposed opposite the fixing roller 100 and a cam 104 are arranged in the above order downstream of the transfer roller 52 in the sheet transport direction. The sheet of recording paper P having the toner image thereon is held between the fixing roller 100 and the roller 102 to fix the toner image and is transported to the position where the cam 104 is disposed. The cam 104 is rotated by a motor (not shown) and is fixed at the position indicated by the solid line or the phantom line in FIG. 1.

When the sheet of recording paper P is transported from the fixing roller 100 to the cam 104, the cam 104 is rotated away from the fixing roller 100 (to the position indicated by the solid line). The sheet of recording paper P transported from the fixing roller 100 is guided along the outer surface of the cam 104 to a pair of rollers 106. The pairs of rollers 106 and other pairs of rollers 108, 112, and 114 are arranged in the above order downstream of the cam 104 in the sheet guide direction. A sheet bin 202 is disposed downstream of the pair of rollers 114 in the sheet transport direction.

The sheet of recording paper P transported from the fixing roller 100 is held between the pairs of rollers 106 and 108 and is transported to the sheet bin 202 as the pairs of rollers 106 and 108 rotate continuously.

To invert the sheet of recording paper P held between the pairs of rollers 106 and 108 after image formation on one side thereof, the cam 104 is rotated toward the fixing roller 100 (to the position indicated by the phantom line). In this state, the pairs of rollers 106 and 108 are rotated in the reverse direction, and accordingly, the sheet of recording paper P is transported in the reverse direction (hereinafter referred to as "switched back"). As the sheet of recording paper P is transported from the pairs of rollers 106 and 108 toward the cam 104, the sheet of recording paper P is guided downward along the outer surface of the cam 104. A pair of rollers 120 are disposed downstream of the cam 104 in the sheet transport direction. The sheet of recording paper P is transported to the position where the pair of rollers 120 are disposed and is further transported by the transport force of the pair of rollers 120.

In FIG. 1, the transport path of the sheet of recording paper P is indicated by the phantom line.

Pairs of rollers 122, 124, 126, 128, 130, and 132 are arranged in the above order downstream of the pair of rollers 120 along the transport path of the sheet of recording paper P indicated by the phantom line in FIG. 1. The cam 104 and the pairs of rollers 106, 108, 120, 122, 124, 126, 128, 130, and 132 form a sheet-inverting unit 220. The sheet of recording paper P switched back at the position where the pairs of rollers 106 and 108 are disposed is transported along the transport path indicated by the phantom line in FIG. 1 to the position where the pair of rollers 90 are disposed and is transported back to the nip between the photoreceptor 10 and the transfer roller 52.

Since the sheet of recording paper P has been switched back by the sheet-inverting unit 220, as described above, the back side, which is opposite the side on which an image has been formed first, faces the photoreceptor 10. After a toner image is transferred to the back side and is fixed by the fixing roller 100, the sheet of recording paper P has images on both sides. The sheet of recording paper P having images on both sides is output to the sheet bin 202 such that the side on which an image has been formed later faces downward. If no image is formed on the sheet of recording paper P in the later image-forming process (i.e., in the image-forming process after the inversion of the sheet of recording paper P by the sheet-inverting unit 220), the sheet of recording paper P is output to the sheet bin 202 such that the side on which an image has been formed first faces upward.

Examples of recording paper P to which toner images are transferred include plain paper for use in devices such as electrophotographic copiers and printers. Examples of recording media other than recording paper include OHP sheets. The recording paper P may also be, for example, coated paper, which is plain paper coated with a material such as resin, or art paper for printing.

Process Cartridge and Toner Cartridge

A process cartridge according to an exemplary embodiment of the present invention will now be described.

The process cartridge according to this exemplary embodiment is attachable to and detachable from an image-forming apparatus and includes a developing unit containing the electrostatic image developer according to the above exemplary embodiment. The developing unit develops an electrostatic image formed on a surface of an image carrier with the electrostatic image developer to form a toner image.

The process cartridge according to this exemplary embodiment may have other configurations. For example, the process cartridge according to this exemplary embodiment may include the developing unit and optionally at least one other unit selected from an image carrier, a charging unit, an electrostatic-image forming unit, and a transfer unit.

A non-limiting example of the process cartridge according to this exemplary embodiment will now be described. The parts shown in the drawings are described, and other parts are not described.

Figure 2:
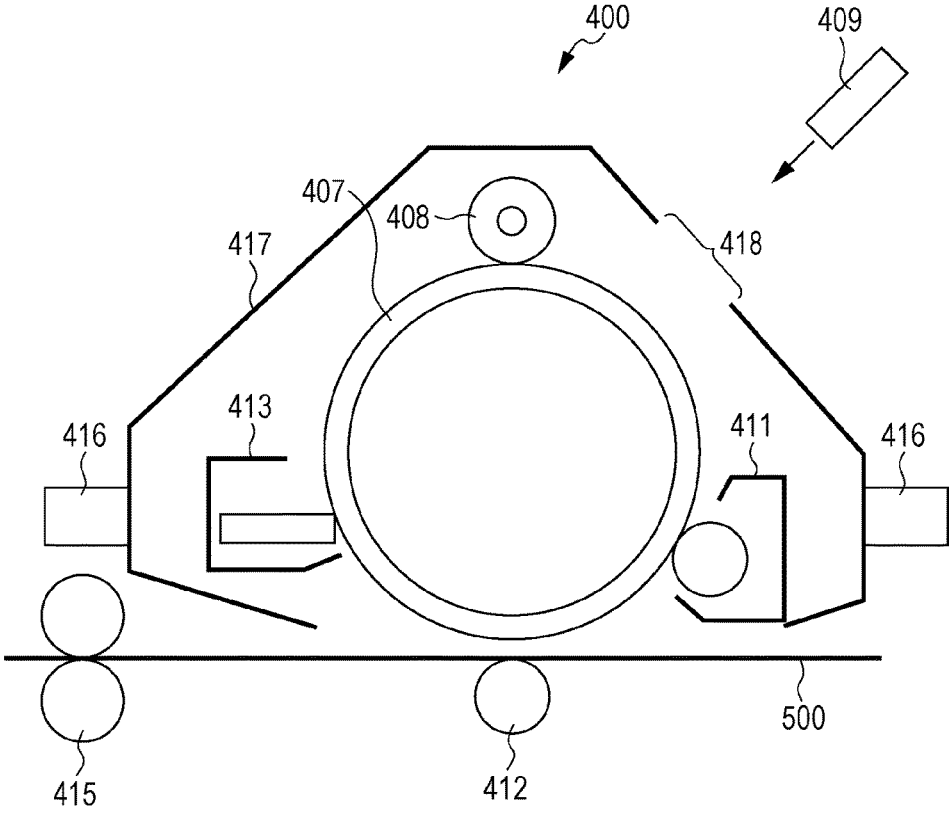
FIG. 2 is a schematic view of an example of a process cartridge according to an exemplary embodiment of the present invention.

FIG. 2 is a schematic view of the process cartridge according to this exemplary embodiment.

A process cartridge 400 shown in FIG. 2 includes, for example, a photoreceptor (an example of an image carrier) 407 around which are arranged a charging roller (an example of a charging unit) 408, a developing device (an example of a developing unit) 411, and a photoreceptor-cleaning device (an example of a cleaning unit) 413. The photoreceptor 407, the charging roller 408, the developing device 411, and the photoreceptor-cleaning device 413 are assembled into a cartridge with a housing 417 having mounting rails 416 and an opening 418 for exposure.

FIG. 2 also shows an exposure device (an example of an electrostatic-image forming unit) 409, a transfer device (an example of a transfer unit) 412, a fixing device (an example of a fixing unit) 415, and a sheet of recording paper (an example of a recording medium) 500. FIG. 2 does not show a toner reclaim mechanism by which toner removed by the photoreceptor-cleaning device 413 is supplied to and reused in the developing device 411, for example, through a supply transport path (an example of a toner supply unit).

A toner cartridge according to an exemplary embodiment of the present invention will now be described.

The toner cartridge according to this exemplary embodiment is attachable to and detachable from an image-forming apparatus and contains the toner according to the above exemplary embodiment. The toner cartridge contains refill toner to be supplied to a developing unit provided in an image-forming apparatus.

As shown in FIG. 1, the toner cartridge 46 is attachable to and detachable from the image-forming apparatus 300. The developing device 40 is connected to the toner cartridge 46 through the toner supply tube (not shown). The toner cartridge 46 is replaced when the toner level thereof is low.

EXAMPLES

The present invention is further illustrated by the following non-limiting examples. In the following description, all parts and percentages are by mass unless otherwise specified.

Preparation of Polyester Resin Particle Dispersions
Preparation of Polyester Resin Particle Dispersion (1)
Adduct of bisphenol A with 2.2 mol of ethylene oxide: 40 molar parts Adduct of bisphenol A with 2.2 mol of propylene oxide: 60 molar parts Terephthalic acid: 47 molar parts Fumaric acid: 40 molar parts Dodecenylsuccinic anhydride: 15 molar parts Trimellitic anhydride: 3 molar parts In a reaction vessel equipped with a stirrer, a thermometer, a condenser, and a nitrogen gas inlet tube are placed the above monomers except fumaric acid and trimellitic anhydride and tin dioctanoate in an amount of 0.25 part per 100 parts of all monomers. The mixture is reacted in a nitrogen stream at 235° C. for 6 hours. After the mixture is cooled to 200° C., fumaric acid and trimellitic anhydride are added and reacted for 1 hour. The mixture is further heated to 220° C. over 4 hours. The monomers are polymerized to the desired molecular weight at 10 kPa to obtain Polyester Resin (1), which is transparent and light yellow.

Polyester Resin (1) has a glass transition temperature (Tg) of 59° C. as determined by DSC, a weight average molecular weight (Mw) of 25,000 as determined by GPC, a number average molecular weight (Mn) of 7,000 as determined by GPC, a softening temperature of 107° C. as determined using a flow tester, an acid value (AV) of 13 mg KOH/g.

A mixture of 1,000 parts of ethyl acetate and 100 parts of isopropyl alcohol is placed in a 3 L jacketed reaction vessel (BJ-30N, Tokyo Rikakikai Co., Ltd.) equipped with a condenser, a thermometer, a water dropping unit, and an anchor blade while the reaction vessel is maintained at 40° C. in a water-circulated thermostatic bath. To the reaction vessel is added 300 parts of Polyester Resin (1), and it is dissolved with stirring at 150 rpm using a Three-One Motor mixer to obtain an oil phase. To the oil phase being stirred, 14 parts of 10% aqueous ammonia is added dropwise over 5 minutes. After mixing for 10 minutes, 900 parts of ion exchange water is added dropwise at a rate of 7 parts per minute to cause phase inversion and thereby obtain an emulsion. Immediately, 800 parts of the resulting emulsion and 700 parts of ion exchange water are placed in a 2 L recovery flask. The recovery flask is attached to an evaporator (Tokyo Rikakikai Co., Ltd.) equipped with a vacuum control unit with a trap therebetween. While the recovery flask is being rotated, it is warmed in a water bath at 60° C., and the pressure is reduced to 7 kPa without causing bumping to remove the solvent. When 1,100 parts of the solvent is recovered, the recovery flask is returned to the atmospheric pressure and is water-cooled to obtain a dispersion. The resulting dispersion has no solvent odor. The resin particles in the dispersion have a volume average particle size D50 of 130 nm. Ion exchange water is then added to a solid content of 20% to obtain Polyester Resin Particle Dispersion (1).

Preparation of Crystalline Polyester Resin Particle Dispersion (1)

1,10-Dodecanedioic acid: 50 molar parts 1,9-Nonanediol: 50 molar parts

The above monomers are placed in a reaction vessel equipped with a stirrer, a thermometer, a condenser, and a nitrogen gas inlet tube. After the reaction vessel is purged with dry nitrogen gas, titanium tetrabutoxide (reagent) is added in an amount of 0.25 part per 100 parts of the monomers. The mixture is reacted with stirring in a nitrogen stream at 170° C. for 3 hours. The mixture is further heated to 210° C. over 1 hour, and the pressure in the reaction vessel is reduced to 3 kPa. The mixture is reacted with stirring under reduced pressure for 13 hours to obtain Crystalline Polyester Resin (1).

Crystalline Polyester Resin (1) has a melting temperature of 73.6° C. as determined by DSC, a weight average molecular weight (Mw) of 25,000 as determined by GPC, a number average molecular weight (Mn) of 10,500 as determined by GPC, and an acid value (AV) of 10.1 mg KOH/g.

In a 3 L jacketed reaction vessel (BJ-30N, Tokyo Rikakikai Co., Ltd.) equipped with a condenser, a thermometer, a water dropping unit, and an anchor blade are placed 300 parts of Crystalline Polyester Resin (1), 1,000 parts of methyl ethyl ketone (solvent), and 100 parts of isopropyl alcohol (solvent). While the reaction vessel is maintained at 70° C. in a water-circulated thermostatic bath, the resin is dissolved with stirring at 100 rpm (solution-preparing step).

The rotational speed for stirring is then increased to 150 rpm, and the water-circulated thermostatic bath is set to 66° C. After 17 parts of 10% aqueous ammonia is added over 10 minutes, a total of 900 parts of ion exchange water warmed to 66° C. is added dropwise at a rate of 7 parts per minute to cause phase inversion and thereby obtain an emulsion. Immediately, 800 parts of the resulting emulsion and 700 parts of ion exchange water are placed in a 2 L recovery flask. The recovery flask is attached to an evaporator (Tokyo Rikakikai Co., Ltd.) equipped with a vacuum control unit with a trap therebetween. While the recovery flask is being rotated, it is warmed in a water bath at 60° C., and the pressure is reduced to 7 kPa without causing bumping to remove the solvent. When 1,100 parts of the solvent is recovered, the recovery flask is returned to the atmospheric pressure and is water-cooled to obtain a dispersion. The resulting dispersion has no solvent odor. The resin particles in the dispersion have a volume average particle size D50 of 130 nm. Ion exchange water is then added to a solid content of 20% to obtain Crystalline Polyester Resin Particle Dispersion (1).

Preparation of Styrene-(Meth)Acrylic Resin Particle Dispersions

Preparation of Styrene-Acrylic Resin Particle Dispersion (1)

Styrene (Wako Pure Chemical Industries, Ltd.): 300 parts n-Butyl acrylate (Wako Pure Chemical Industries, Ltd.): 84 parts 1,10-Decanediol diacrylate (Shin Nakamura Chemical Co., Ltd.): 1.4 parts Dodecanethiol (Wako Pure Chemical Industries, Ltd.): 3.0 parts β-Carboxyethyl acrylate: 0.15 part The above ingredients are mixed and dissolved. To the mixture is added a solution of 4.0 parts of an anionic surfactant (Dowfax, The Dow Chemical Company) in 800 parts of ion exchange water, and the mixture is dispersed and emulsified in the flask. A solution of 4.0 parts of ammonium persulfate in 50 parts of ion exchange water is then added with gentle stirring over 10 minutes. After the flask is purged with nitrogen, the solution in the flask is heated to 65° C. in an oil bath with stirring. In this state, emulsion polymerization is continued for 5 hours to obtain Styrene-Acrylic Resin Particle Dispersion (1). Ion exchange water is then added to Styrene-Acrylic Resin Particle Dispersion (1) to a solid content of 32%.

Preparation of Styrene-Acrylic Resin Particle Dispersions (2) to (4)

Styrene-Acrylic Resin Particle Dispersions (2) to (4) are prepared by the same procedure as Styrene-Acrylic Resin Particle Dispersion (1) except that the amount (parts) of β-CEA is changed as shown in Table 1.

TABLE 1

| | Styrene-acrylic resin particle dispersion | | | |
|---|---|---|---|---|
| | (1) Amount (parts) | (2) Amount (parts) | (3) Amount (parts) | (4) Amount (parts) |
| Styrene | 300 | 300 | 300 | 300 |
| n-Butyl acrylate | 84 | 84 | 84 | 84 |
| 1,10-Decanediol diacrylate | 1.4 | 1.4 | 1.4 | 1.4 |
| Dodecanethiol | 3.0 | 3.0 | 3.0 | 3.0 |
| β-Carboxyethyl acrylate | 0.15 | 0.08 | 0.5 | 1.2 |

Preparation of Colorant Particle Dispersion

Preparation of Black Pigment Dispersion (1)

Carbon black (Regal 330, Cabot Corporation): 250 parts

Anionic surfactant (Neogen SC, DKS Co. Ltd.): 33 parts (effective amount=60%, 8% relative to colorant)

Ion exchange water: 750 parts

In a stainless steel vessel sized to be filled to about one-third of its height when all the above ingredients are placed therein are placed 280 parts of ion exchange water and 33 parts of the anionic surfactant. After the surfactant is sufficiently dissolved, all solid pigment is added, and the mixture is stirred using a stirrer until there is no dry pigment and is sufficiently degassed. After degassing, the remaining ion exchange water is added, and the mixture is dispersed at 5,000 rpm using a homogenizer (Ultra-Turrax T50, IKA) for 10 minutes and is degassed with stirring using a stirrer for one day. After degassing, the mixture is dispersed again at 6,000 rpm using the homogenizer for 10 minutes and is degassed with stirring using a stirrer for one day. The mixture is further dispersed at 240 MPa using a high-pressure impact disperser (Ultimaizer HJP-30006, Sugino Machine Limited). The mixture is dispersed in 25 equivalent passes based on the total amount of feed and the processing capacity of the machine. The resulting dispersion is left standing for 72 hours, and the sediment is removed. Ion exchange water is then added to a solid content of 15% to obtain Black Pigment Dispersion (1). The particles in Black Pigment Dispersion (1) have a volume average particle size D50 of 135 nm.

Preparation of Release Agent Particle Dispersion

Preparation of Release Agent Particle Dispersion (1)

Polyethylene wax (hydrocarbon wax, the trade name "Polywax 725" (Baker Petrolite)): 270 parts Anionic surfactant (Neogen RK, DKS Co. Ltd., effective amount=60%): 13.5 parts (effective amount=3.0% relative to release agent)

Ion exchange water: 21.6 parts

The above ingredients are mixed together. After the release agent is dissolved at 120° C., the mixture is dispersed at 5 MPa for 120 minutes and then at 40 MPa for 360 minutes using a pressure discharge homogenizer (Gaulin homogenizer, Gaulin). The resulting mixture is cooled to obtain Release Agent Particle Dispersion (1). The particles in Release Agent Particle Dispersion (1) have a volume average particle size D50 of 225 nm. Ion exchange water is then added to a solid content of 20.0%.

Preparation of Mixed Particle Dispersions

Preparation of Mixed Particle Dispersion (1)

A mixture of 400 parts of Polyester Resin Particle Dispersion (1), 60 parts of Release Agent Particle Dispersion (1), and 2.9 parts of an anionic surfactant (Dowfax 2A1, The Dow Chemical Company) is prepared. The mixture is adjusted to a pH of 3.0 at 25° C. by adding 1.0% nitric acid to obtain Mixed Particle Dispersion (1).

Preparation of Mixed Particle Dispersion (2)

Mixed Particle Dispersion (2) is prepared in the same manner as Mixed Particle Dispersion (1) except that the amount of Release Agent Particle Dispersion (1) is changed to 75 parts.

Example 1

Preparation of Toner Particles (1)

Polyester Resin Particle Dispersion (1): 700 parts

Crystalline Polyester Resin Particle Dispersion (1): 50 parts

Styrene-Acrylic Resin Particle Dispersion (1): 205 parts

Black Pigment Dispersion (1): 133 parts

Release Agent Particle Dispersion (1): 15 parts

Ion exchange water: 600 parts

Anionic surfactant: 2.9 parts (Dowfax 2A1, The Dow Chemical Company)

The above ingredients are placed in a 3 L reaction vessel equipped with a thermometer, a pH meter, and a stirrer. The mixture is adjusted to a pH of 3.0 at 25° C. by adding 1.0% nitric acid. While the mixture is being dispersed at 5,000 rpm using a homogenizer (Ultra-Turrax T50, IKA), 100 parts of 2.0% aqueous aluminum sulfate solution is added, and the mixture is dispersed for 6 minutes.

The reaction vessel is then equipped with a mantle heater. The slurry is heated to 40° C. at 0.2° C./min and then to 53° C. at 0.05° C./min while the rotational speed of the stirrer is controlled so that the slurry is sufficiently stirred. During this process, the particle size is measured using a Multisizer II (aperture size=50 μm, Beckman Coulter, Inc.) every 10 minutes. When a volume average particle size of 5.0 μm is reached, the temperature is maintained, and 460 parts of Mixed Particle Dispersion (1) is added over 5 minutes.

After the mixture is maintained at 50° C. for 30 minutes, 8 parts of 20% EDTA is added to the reaction vessel, and the ingredient dispersion is adjusted to a pH of to 9.0 by adding 1 mol/L aqueous sodium hydroxide solution. The dispersion is heated to 90° C. at 1° C./min while being adjusted to a pH of to 9.0 every 5° C. and is maintained at 90° C. Examination under a light microscope and an FE-SEM for particle shape and surface condition showed that the particles coalesced after six hours. The vessel is cooled with cooling water to 30° C. over 5 minutes.

After cooling, the slurry is passed through a 15 μm nylon mesh to remove coarse particles. The toner slurry passed through the mesh is filtered under reduced pressure using an aspirator. The solid remaining on the filter paper is finely crushed by hand and is added to ion exchange water at 30° C. in an amount of 10 times the amount of solid, and the mixture is stirred for 30 minutes. The mixture is then filtered under reduced pressure using an aspirator. The solid remaining on the filter paper is finely crushed by hand and is added to ion exchange water at 30° C. in an amount of 10 times the amount of solid, and the mixture is stirred for 30 minutes. The mixture is filtered again under reduced pressure using an aspirator, and the electrical conductivity of the filtrate is measured. This procedure is repeated until the electrical conductivity of the filtrate is 10 μS/cm or less, and the solid is washed. The washed solid is finely crushed in a wet/dry mill (Comil) and is vacuum-dried in an oven at 35° C. for 36 hours to obtain Toner Particles (1). Toner Particles (1) have a volume average particle size of 6.0 μm.

Preparation of Toner Particles (2), (3), and (C2)

Toner Particles (2), (3), and (C2) are prepared in the same manner as Toner Particles (1) except that the type of styrene-acrylic resin particle dispersion is changed as shown in Table 2.

Preparation of Toner Particles (4)

Toner Particles (4) are prepared in the same manner as Toner Particles (1) except that the amount of Release Agent Particle Dispersion (1) is changed from 15 parts to 0 part and Mixed Particle Dispersion (1) is replaced with Mixed Particle Dispersion (2).

Preparation of Toner Particles (C1)

Toner Particles (C1) are prepared in the same manner as Toner Particles (1) except that the amount of Styrene-Acrylic Resin Particle Dispersion (1) is changed to 0 part (i.e., no styrene-acrylic resin particle dispersion is used).

TABLE 2

| Toner particle No. | Styrene-acrylic resin particle dispersion No. |
|---|---|
| (1) | (1) |
| (2) | (2) |
| (3) | (3) |
| (4) | (1) |
| (C1) | None |
| (C2) | (4) |

Preparation of Titanium Oxide Particles (1)

Commercially available untreated titanium oxide particles are subjected to hydrophobic treatment as follows. To 35 parts of MT-500A (Tayca Corporation, titanium oxide particles with a number average particle size of 35 nm) is added 7 parts of hexamethyldisilazane. The mixture is reacted at 150° C. for 2 hours to obtain Titanium Oxide Particles (1), which have surfaces subjected to hydrophobic treatment.

Preparation of Titanium Oxide Particles (2)

Titanium Oxide Particles (2) are prepared in the same manner as Titanium Oxide Particles (1) except that the titanium oxide particles with a number average particle size of 35 nm are replaced with titanium oxide particles with a number average particle size of 15 nm (MT-150A, Tayca Corporation).

Preparation of Titanium Oxide Particles (3)

Titanium Oxide Particles (3) are prepared in the same manner as Titanium Oxide Particles (1) except that the titanium oxide particles with a number average particle size of 35 nm are replaced with titanium oxide particles with a number average particle size of 50 nm (MT-600B, Tayca Corporation).

Preparation of Titanium Oxide Particles (4)

Titanium Oxide Particles (4) are prepared in the same manner as Titanium Oxide Particles (1) except that the titanium oxide particles with a number average particle size of 35 nm are replaced with titanium oxide particles with a number average particle size of 80 nm (MT-700, Tayca Corporation).

Preparation of Titanium Oxide Particles (5)

Titanium Oxide Particles (5) are prepared in the same manner as Titanium Oxide Particles (1) except that the titanium oxide particles with a number average particle size of 35 nm are replaced with titanium oxide particles with a number average particle size of 20 nm.

Preparation of Carrier (1)

In a Henschel mixer are placed 500 parts by mass of a powder of spherical magnetite particles with a volume average particle size of 0.22 μm. After sufficient stirring, 4.5 parts by mass of a titanate coupling agent is added. The mixture is heated to 95° C. and is stirred for 30 minutes to obtain titanate-coupling-agent-coated spherical magnetite particles.

In a 1 L four-necked flask are placed 6.5 parts by mass of phenol, 10 parts by mass of 30% formalin, 500 parts by mass of the magnetite particles, 7 parts by mass of 25% aqueous ammonia, and 400 parts by mass of water, and the mixture is stirred. The mixture is then heated to 85° C. with stirring in 60 minutes and is reacted at the same temperature for 180 minutes. After cooling to 25° C., 500 mL of water is added, the supernatant is removed, and the sediment is washed with water. The sediment is dried at 180° C. under reduced pressure and is passed through a 106 μm mesh screen to remove coarse particles and thereby obtain Core Particles A, which have an average particle size of 32 μm. A mixture of 200 parts by mass of toluene and 45 parts by mass of styrene-methacrylate copolymer (constituent molar ratio=20:80, weight average molecular weight=180,000) is then stirred with a stirrer for 60 minutes to obtain a coating resin solution.

In a vacuum degassing kneader coater (rotor-to-wall clearance=25 mm) are placed 1,000 parts by mass of Core Particles A and 40 parts by mass of the coating resin solution. The mixture is maintained at 60° C. and is stirred at 40 rpm for 30 minutes. The mixture is then heated to 85° C., and the pressure is reduced to remove toluene and degas and dry the mixture. The mixture is then passed through a 75 μm mesh to obtain Carrier (1). Carrier (1) has a shape factor SF2 of 106.

Preparation of Carrier (2)

Carrier (2) is prepared in the same manner as Carrier (1) except that Core Particles A are replaced with sintered ferrite particles with an average particle size of 33 μm. Carrier (2) has a shape factor SF2 of 125.

Preparation of Carrier (3)

Core Particles B are prepared in the same manner as Core Particles A except that the powder of spherical magnetite particles having a volume average particle size of 0.22 μm is replaced with a powder of spherical magnetite particles having a volume average particle size of 0.65 μm. Core Particles B have an average particle size of 41 μm.

Carrier (3) is prepared in the same manner as Carrier (1) except that 1,000 parts by mass of Core Particles B and 15 parts by mass of the coating resin solution are used. Carrier (3) has a shape factor SF2 of 118.

Preparation of Carrier (4)

In a kneader is placed 1,000 parts of Mn—Mg ferrite (Powdertech Co., Ltd., volume average particle size=50 μm, shape factor SF1=120). To the kneader is added a solution of 150 parts of perfluorooctylmethyl acrylate-methyl methacrylate copolymer (Soken Chemical & Engineering Co., Ltd., ratio of polymerization=20/80, Tg=72° C., weight average molecular weight=72,000) in 700 parts of toluene. The mixture is stirred at room temperature (22° C.) for 20 minutes. The mixture is then heated to 70° C. and is dried under reduced pressure to obtain a coated carrier. The resulting coated carrier is passed through a 75 μm mesh to remove coarse particles and thereby obtain Carrier (4). Carrier (4) has a shape factor SF2 of 120.

Preparation of Toner (1)

In a Henschel mixer are placed 100 parts of Toner Particles (1) and 1.5 parts of Titanium Oxide Particles (1). The mixture is stirred at a peripheral speed of 20 m/s for 15 minutes and is passed through a 45 μm mesh sieve to remove coarse particles and thereby obtain Toner (1).

Preparation of Developer (1)

In a V-blender are placed 8 parts of Toner (1) and 100 parts of Carrier (1). The mixture is stirred at 20 rpm for 20 minutes and is passed through a 212 μm mesh sieve to obtain Developer (1).

Examples 2 to 12 and Comparative Examples 1 and 2

Toners (2) to (12), (C1), and (C2) and Developer (2) to (12), (C1), and (C2) are prepared in the same manner as Toner (1) except that the type of toner particles, the type and amount of titanium oxide particles, and the type of carrier are changed as shown in Table 3.

Evaluation

Presence Rate of Release Agent

The proportion of the release agent present within 800 nm or about 800 nm from the surfaces of the toner particles (the presence rate of the release agent) is determined by the method described above.

Surface Presence Rate of Styrene-(Meth)Acrylic Resin

The proportion of the styrene-(meth)acrylic resin in the resin components present in the surfaces of the toner particles as determined by XPS (the surface presence rate of the styrene-(meth)acrylic resin) is determined by the method described above.

Evaluation for Color Spots and Streaks

The above developers are charged into a developing device of a modified Fuji Xerox DocuCentre-IV 4070.

Using this image-forming apparatus, 30,000 images with an image density of 1% are formed at high temperature and humidity (35° C. and 90% RH). Ten images of a full-page halftone (image density=50%) chart are then continuously formed and evaluated for the number of color spots or streaks with sizes of 0.5 mm or more in the images on the following scale:

A: 0 color spots or streaks with sizes of 0.5 mm or more

B: 1 to 4 color spots or streaks with sizes of 0.5 mm or more

C: 5 to 8 color spots or streaks with sizes of 0.5 mm or more

D: 9 or more color spots or streaks with sizes of 0.5 mm or more

TABLE 3

| | Toner | | | | | | Developer | | | | |
|---|---|---|---|---|---|---|---|---|---|---|---|
| | | Toner particles | | | External additive | | Carrier | | | | |
| | Toner No. | Toner particle No. | Presence rate of release agent (%) | Surface presence rate of St-Ac resin (atom %) | Titanium oxide particles | Particle size (nm) | Carrier No. | Core | Shape factor (SF2) | Developer No. | Image evaluation |
| Example 1 | (1) | (1) | 75 | 15 | (1) | 35 | (1) | Magnetic-powder-dispersed | 106 | (1) | A |
| Example 2 | (2) | (2) | 75 | 5 | (1) | 35 | (1) | Magnetic-powder-dispersed | 106 | (2) | C |
| Example 3 | (3) | (3) | 75 | 23 | (1) | 35 | (1) | Magnetic-powder-dispersed | 106 | (3) | C |
| Example 4 | (4) | (1) | 75 | 15 | (2) | 15 | (1) | Magnetic-powder-dispersed | 106 | (4) | B |
| Example 5 | (5) | (1) | 75 | 15 | (3) | 50 | (1) | Magnetic-powder-dispersed | 106 | (5) | A |
| Example 6 | (6) | (1) | 75 | 15 | (4) | 80 | (1) | Magnetic-powder-dispersed | 106 | (6) | B |
| Example 7 | (7) | (1) | 75 | 15 | None | 30(silica) | (1) | Magnetic-powder-dispersed | 106 | (7) | B |
| Example 8 | (8) | (1) | 75 | 15 | (1) | 35 | (2) | Magnetic-powder-dispersed | 125 | (8) | B |
| Example 9 | (9) | (1) | 75 | 15 | (1) | 35 | (3) | Magnetic-powder-dispersed | 118 | (9) | A |
| Example 10 | (10) | (1) | 75 | 15 | (1) | 35 | (4) | Mn—Mg ferrite | 120 | (10) | B |
| Example 11 | (11) | (4) | 90 | 15 | (1) | 35 | (1) | Magnetic-powder-dispersed | 106 | (11) | A |
| Example 12 | (12) | (1) | 75 | 15 | (5) | 20 | (1) | Magnetic-powder-dispersed | 106 | (12) | A |
| Comparative Example 1 | (C1) | (C1) | 75 | 0 | (1) | 35 | (1) | Magnetic-powder-dispersed | 106 | (C1) | D |
| Comparative Example 2 | (C2) | (C2) | 75 | 30 | (1) | 35 | (1) | Magnetic-powder-dispersed | 106 | (C2) | D |

In Table 3, the term "surface presence rate of St-Ac resin" refers to the surface presence rate of the styrene-(meth) acrylic resin (i.e., the proportion of the styrene-(meth)acrylic resin in the resin components present in the surfaces of the toner particles as determined by XPS).

In the "titanium oxide particles" column of Table 3, the term "none" means that no titanium oxide particles are added, and silica particles are added alone.

The above results demonstrate that the developers of the Examples achieve better results in the image evaluation than the developers of the Comparative Examples. This indicates that the developers of the Examples cause fewer color spots and streaks than the developers of the Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic-image developing toner comprising toner particles comprising:

a binder resin comprising a polyester resin;

a release agent; and a styrene-(meth)acrylic resin, wherein

70% or more of all release agent is present within 800 nm from surfaces of the toner particles, and the styrene-(meth)acrylic resin is present in an amount of 5 to 25 atomic percent of the resin components in the surfaces of the toner particles as determined by X-ray photoelectron spectroscopy (XPS).

2. The electrostatic-image developing toner according to claim 1, wherein the polyester resin has a glass transition temperature (Tg) of 50° C. to 80° C.

3. The electrostatic-image developing toner according to claim 1, wherein the polyester resin has a weight average molecular weight (Mw) of 5,000 to 1,000,000.

4. The electrostatic-image developing toner according to claim 1, wherein the polyester resin has a molecular weight distribution Mw/Mn of 1.5 to 100, and wherein Mw is a weight average molecular weight of the polyester resin and Mn is a number average molecular weight of the polyester resin.

5. The electrostatic-image developing toner according to claim 1, wherein the binder resin is present in an amount of 40% to 95% of the total mass of the toner particles.

6. The electrostatic-image developing toner according to claim 1, wherein the styrene-(meth)acrylic resin is a polymer of a styrene monomer and a (meth)acrylic monomer in a ratio (styrene monomer/(meth)acrylic monomer) of 85/15 to 70/30.

7. The electrostatic-image developing toner according to claim 1, wherein the styrene-(meth)acrylic resin has a glass transition temperature (Tg) of 50° C. to 75° C.

8. The electrostatic-image developing toner according to claim 1, wherein the styrene-(meth)acrylic resin has a weight average molecular weight of 30,000 to 200,000.

9. The electrostatic-image developing toner according to claim 1, wherein the release agent comprises a hydrocarbon wax in an amount of 85% to 100% of the total mass of the release agent.

10. The electrostatic-image developing toner according to claim 1, wherein the release agent has a melting temperature of 50° C. to 110° C.

11. The electrostatic-image developing toner according to claim 1, wherein the release agent is present in an amount of 1% to 20% of the total mass of the toner particles.

12. The electrostatic-image developing toner according to claim 1, wherein the binder resin further comprises a crystalline polyester resin.

13. The electrostatic-image developing toner according to claim 12, wherein the crystalline polyester resin has a melting temperature of 50° C. to 100° C.

14. The electrostatic-image developing toner according to claim 12, wherein the crystalline polyester resin has a weight average molecular weight (Mw) of 6,000 to 35,000.

15. The electrostatic-image developing toner according to claim 1, further comprising an external additive comprising titanium oxide particles having a number average particle size of 20 to 50 nm.

16. The electrostatic-image developing toner according to claim 15, wherein the titanium oxide particles are present in an amount of 0.01% to 5% of the total mass of the toner particles.

17. An electrostatic image developer comprising the electrostatic-image developing toner according to claim 1.

18. The electrostatic image developer according to claim 17, further comprising a carrier having a shape factor SF2 of 100 to 120.

19. The electrostatic image developer according to claim 18, wherein the carrier is a magnetic-powder-dispersed carrier.

20. A toner cartridge attachable to and detachable from an image-forming apparatus, the toner cartridge containing the electrostatic-image developing toner according to claim 1.

* * * * *